US007431554B2

(12) United States Patent
Westendorf et al.

(10) Patent No.: US 7,431,554 B2
(45) Date of Patent: Oct. 7, 2008

(54) PINCHING FINGERS ATTACHMENT FOR UTILITY VEHICLES

(75) Inventors: Neal W. Westendorf, Dakota Dunes, SD (US); Joseph W. Langenfeld, Onawa, IA (US)

(73) Assignee: Westendorf Manufacturing, Co., Onawa, IA (US)

( * ) Notice: Subject to any disclaimer, the term of this patent is extended or adjusted under 35 U.S.C. 154(b) by 0 days.

(21) Appl. No.: 11/048,240

(22) Filed: Feb. 1, 2005

(65) Prior Publication Data

US 2006/0051194 A1 Mar. 9, 2006

Related U.S. Application Data

(63) Continuation-in-part of application No. 10/934,749, filed on Sep. 3, 2004.

(51) Int. Cl.
*B66C 1/00* (2006.01)

(52) U.S. Cl. ..... 414/729; 294/88

(58) Field of Classification Search ..... 414/724, 414/729, 739; 37/406; 294/88, 86.4
See application file for complete search history.

(56) References Cited

U.S. PATENT DOCUMENTS

| | | | | |
|---|---|---|---|---|
| 2,326,338 | A | | 8/1943 | Drott et al. |
| 2,812,595 | A | | 11/1957 | Drott et al. |
| 3,077,999 | A | | 2/1963 | Svoboda |
| 3,243,905 | A | | 4/1966 | Ulrich |
| 3,344,540 | A | | 10/1967 | Ulrich |
| 3,455,477 | A | | 7/1969 | Blair |
| 3,512,665 | A | | 5/1970 | Westendorf |
| 4,030,625 | A | | 6/1977 | Koehnen |
| 4,085,856 | A | | 4/1978 | Westendorf |
| RE29,805 | E | | 10/1978 | Koehnen |
| 4,266,819 | A | | 5/1981 | Pemberton |
| 4,285,628 | A | | 8/1981 | Jankowski |
| 4,423,997 | A | | 1/1984 | Pemberton |
| 4,538,955 | A | | 9/1985 | Langenfeld et al. |
| 4,565,485 | A | | 1/1986 | Wilman |
| 4,566,844 | A | | 1/1986 | Campin |
| 4,606,692 | A | | 8/1986 | Langenfeld et al. |
| 4,787,811 | A | | 11/1988 | Langenfeld et al. |
| 4,907,356 | A | * | 3/1990 | Labounty ..... 37/406 |
| 4,928,410 | A | | 5/1990 | Walters et al. |
| 4,930,974 | A | | 6/1990 | Langenfeld et al. |
| 5,073,080 | A | | 12/1991 | Blum |
| 5,094,581 | A | | 3/1992 | Lamb |

(Continued)

OTHER PUBLICATIONS

Brochure, The Loader Specialist, WL Series.
SP-43 Bale Lift Operator's Manual.
MDS Manufacturing Co., Inc., Attachment Specialists.

*Primary Examiner*—Donald Underwood
(74) *Attorney, Agent, or Firm*—Dowell Baker, P.C.; Anthony Dowell

(57) ABSTRACT

The improved pinching fingers of the present invention are adapted for easy installation and use on conventional front-end loaders and skid steers. The pinching fingers are opened and closed by the hydraulic cylinder or cylinders used to rotate other common implements, eliminating the need for a separate hydraulic power system for opening and closing the fingers. The pinching fingers also include an equalizer bar and a novel linkage assembly that equalize pressure between the claws and thus allow one claw to continue closing even if the other claw is restricted. This feature allows the pinching fingers to more easily and safely handle irregular and tapered items.

14 Claims, 13 Drawing Sheets

U.S. PATENT DOCUMENTS 5,121,557 A 6/1992 Moore
5,184,934 A 2/1993 Gallo
5,516,174 A 5/1996 Squyres
5,518,359 A 5/1996 Pratt
5,544,435 A * 8/1996 Somero ..... 37/405
5,564,885 A 10/1996 Staben, Jr.
5,779,430 A 7/1998 Ball
5,788,300 A 8/1998 Dickison et al.
5,957,650 A 9/1999 Rollo
5,997,237 A 12/1999 Langenfeld et al.
6,098,320 A 8/2000 Wass
6,176,531 B1 1/2001 Wheeler
6,308,440 B1 10/2001 Mueller
6,523,284 B1 2/2003 Clugston
6,582,177 B1 6/2003 Westendorf et al.
6,601,891 B1 8/2003 Gregory

* cited by examiner

PINCHING FINGERS ATTACHMENT FOR UTILITY VEHICLES

CROSS-REFERENCE TO RELATED APPLICATION

This application is a Continuation-in-Part of application Ser. No. 10/934,749 entitled "Grapple Assembly, A Front End Loader Having a Grapple Assembly, and Method for a Operating a Grapple Assembly" and filed Sep. 3, 2004, the contents of which are incorporated herein by reference.

FIELD OF THE INVENTION

The present invention relates generally to implements for use with tractors, skid steers and the like, and more specifically to a grappler attachment for use with such vehicles, a vehicle with a grappler attachment and a method for using a grappler attachment.

BACKGROUND OF THE INVENTION

Tractors and skid steers are common utility vehicles in the farming, construction and landscaping industries. The primary benefit of these vehicles is their great versatility and the wide variety of implements that can be attached to and used with the vehicle. After an initial investment in a tractor or skid steer, owners of these vehicles can add increased functionality by purchasing a wide variety of specialized implements including loaders, backhoes, blades, post hole diggers, forks and bale spears, to name a few. Because of the ubiquity and great versatility of tractors and skid steers, owners of these vehicles continuously seek new and improved implements to perform specialized tasks.

Pinching fingers are a good example of an implement that is especially useful for performing a specialized task. Pinching fingers are essentially claws that can be opened and closed around material or an item to be transported by the utility vehicle. Because the pinching fingers can be closed around the material or item, bulky and irregularly shaped items can be picked up and securely held while transported by the utility vehicle.

Although they have many uses, pinching fingers are especially useful for transporting logs and clearing brush. Pinching fingers can be clamped around a log so that the log cannot roll when it is picked up, transported and loaded, increasing the safety of working with large logs. Pinching fingers can also be easily clamped around irregularly shaped items such as fallen trees or heavy farm equipment, making it easier to lift and move such items than with conventional implements such as a bucket or forks.

Pinching fingers, however, are not easily adapted for use with conventional tractors or skid steers. Most tractors and all skid steers have arms extending from the front of the vehicle for the operation of a loader or other implements. These implements can be raised and lowered by hydraulic cylinders attached to each arm and also rolled forward and backward by a separate cylinder or cylinders. This range of movement (up, down, forward roll and backward roll) is sufficient for operating most common implements including loaders, blades, forks and spears. Thus, two sets of hydraulic controls, one for raising and lowering the implement and one for rolling the implement forward and backward, are standard on most tractors and skid steers. Pinching fingers, however, also requires means for opening and closing the pincer claws.

Prior art implements for pinching and grappling a load have been adapted for use with conventional tractors and skid steers. These implements typically utilize a third set of hydraulic controls (or other power means) for opening and closing the pincer claws or grappler. This solution, however, increases the cost of the implement because hydraulic cylinders, couplers and lines must be incorporated into the design of the implement. In the case of a tractor or skid steer that does not already have the necessary controls and lines installed, an entire hydraulic control and power system must be installed on the tractor or skid steer to use the implement. This added cost and complexity has prevented many potential users of pinching fingers and grapplers from adopting this useful implements. Thus, those of skill in the art have sought an implement that can be easily attached to a conventional tractor or skid steer without the need for separate controls and power means for opening and closing the implement.

In addition to the problem of requiring a separate set of controls, prior art designs have not been easy to install and remove on a conventional tractor or skid steer. To maximize the versatility and thus the utility of these vehicles, implements must be designed so that they can be quickly interchanged with other implements. Thus, those of skill in the art have sought pinching fingers with simple mechanical means for installing and uninstalling the implement on a conventional tractor or skid steer.

Prior art designs also typically suffer from another deficiency in their operation. To provide structural stability and strength, the top set of pincer claws on a conventional grappler are constructed as a unified or solid piece that clamps in opposition to and against a solid bottom set of pincer claws, forks or a bucket. When grasping an item of uniform cross section, this design is adequate for providing uniform pressure at each claw to secure the item. However, when a solid item to be grasped has a tapered or irregular cross section, one claw may be restricted from closing on the item when the other claw closes on a larger portion of the item, causing the item is held by only one claw and not the other. In this instance, the item cannot be safely transported without the danger of the item moving and shifting during transport. Thus, those of skill in the art have sought a grappler and/or pinching fingers with independent claws that can be closed on an item even if another claw is restricted from closing, but without sacrificing the structural stability or strength of the implement.

Accordingly, an object of the present invention is to provide pinching fingers for a tractor, skid steer or the like that can be used by the vehicle without the need for an additional set of controls and power means for opening and closing the pinching fingers.

A further object of the present invention is to provide pinching fingers that are easy to install and remove on a conventional loader or skid steer.

Yet another object of the present invention is to provide pinching fingers that can be quickly interchanged with other implements on a conventional loader or skid steer.

An additional object of the present invention is to provide pinching fingers that may move and grasp independently so that both claws securely grasp a solid item of tapered or irregular cross section.

A still further object of the present invention is to provide pinching fingers attachment with sufficient structural stability and strength to grasp, lift and transport heavy items including logs, trees and other items.

Still another object of the present invention is to provide an improved vehicle with a pinching fingers attachment.

Yet another object of the present invention is to provide an improved method for using a pinching fingers attachment with loaders, skid steers and the like.

A further object of the invention is to provide a loader or skid steer with pinching fingers that are simple and easy to operate.

Finally, an object of the present invention is to provide a pinching fingers attachment that is economical to manufacture, durable and refined in appearance.

SUMMARY OF THE INVENTION

The preferred embodiment of the present invention provides a pinching fingers implement that can be used with conventional tractors, skid steers and other vehicles with arms for operating implements. The pinching fingers are attached to the ends of the arms of the tractor or skid steer and thus can be raised and lowered like a typical implement. Rather than having their own separate power means for opening and closing, the pinching fingers are opened and closed by the already present hydraulic cylinder or cylinders typically used for rolling an implement forward and backward. A novel linkage configuration enables the pinching fingers to be opened and closed using the existing hydraulic controls on the tractor or skid steer.

In addition, the novel linkage configuration allows the pinching fingers to operate independently so that one finger may be closed on an item even if the other finger is restricted from closing. In applicants' patent application Ser. No. 10/934,749, this independence of the fingers is provided by separate hydraulic cylinders that allow one finger to close even if the other is restricted. Although useful for front end loaders, this configuration is not adaptable to skid steers with a single hydraulic cylinder for rotating implements. Also, the configuration of the '749 application is not easily adaptable to quick change connectors that are connected to and rotated by two hydraulic cylinders on a front end loader or skid steer. The novel linkage configuration of the present invention allows the pinching fingers to be used with skid steers having a single hydraulic cylinder or with a quick change connector controlled by two hydraulic cylinders. As described herein, the linkage configuration allows limited independent movement of the pinching fingers although the opening and closing of the fingers are powered by a single hydraulic cylinder or a pair of hydraulic cylinders operating in unison to rotate a quick change connector.

The pinching finger of the present invention are easy to install and remove on a conventional tractor or skid steer. The pinching fingers have no hydraulic lines to connect to the tractor or skid steer. Also, the pinching fingers can be easily attached to arms of the tractor or skid steer using conventional pins and bolts. A standardized quick release system may also be used so that the pinching fingers may be even more quickly interchanged with other implements adapted for the quick release system.

The pinching fingers of the present invention are simple and easy to operate. The pinching fingers are controlled by the familiar loader controls, making the control of the fingers easier to learn and operate. The pinching fingers require no additional hydraulic connections, hoses, couplers or controls. Because no additional hydraulic components are required, the addition of the pinching fingers to a loader or skid steer does not increase the potential for oil leaks or contamination from additional hydraulic components. Also, no additional hoses are needed, eliminating the possibility that the additional hoses could become torn or frayed.

These and other advantages will become apparent as this specification is read in conjunction with the accompanying drawings and appended claims.

Figure 1:
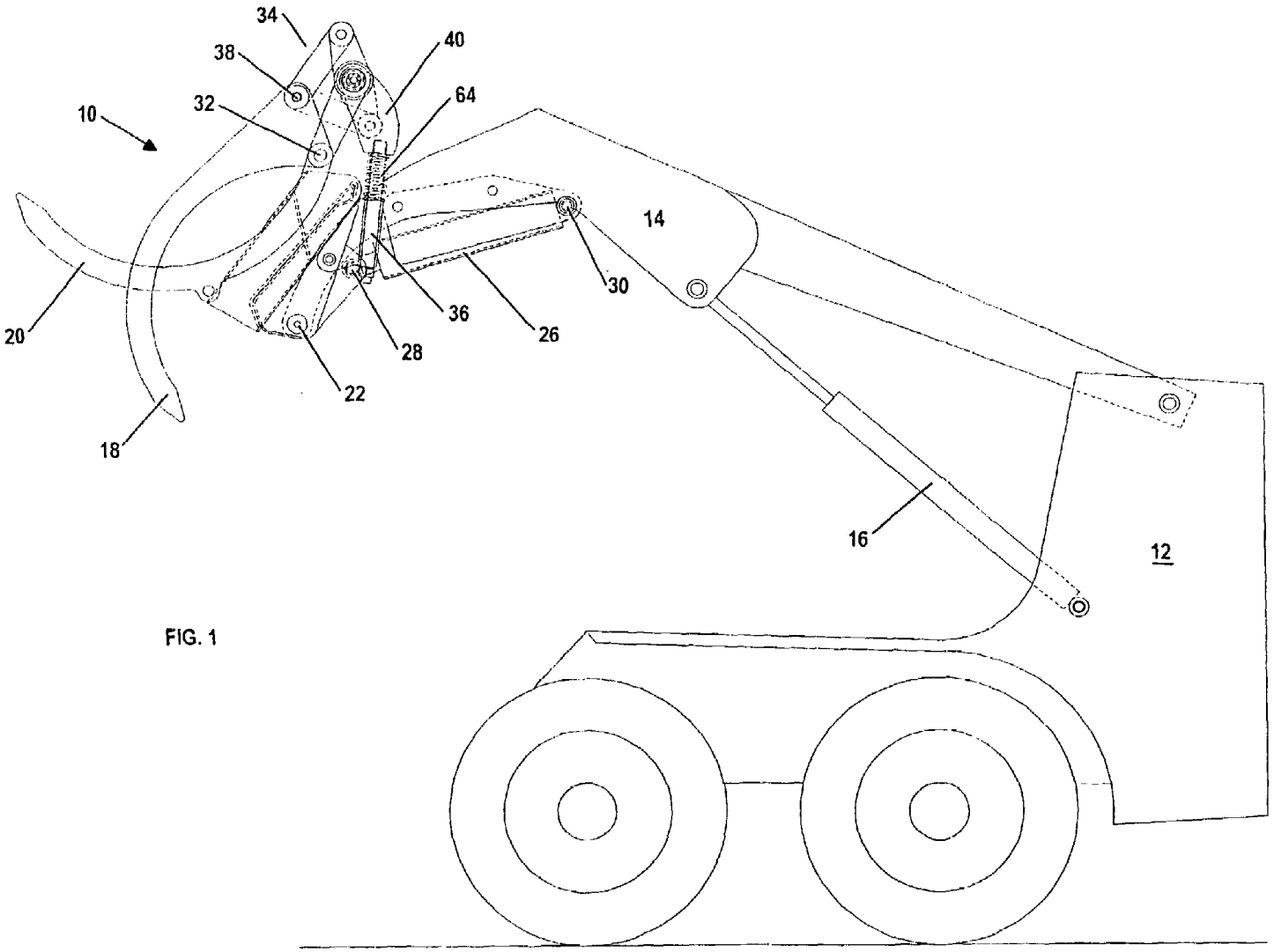
FIG. 1 is a side view of a skid steer with the pinching fingers of the present invention in a closed position.

The drawings are not necessarily to scale and certain details unnecessary for an understanding of the present invention have been omitted. The invention is not limited to the particular embodiments illustrated herein.

In the Figures, the following reference characters are used:

10 pinching finger
12 skid steer
14 left arm
15 right arm
16 left lift cylinder
17 right lift cylinder
18 left top pincer claw
19 right top pincer claw
20 left bottom pincer claw
21 right bottom pincer claw
22 left coupler pivot pin
23 right coupler pivot pin
24 left cylinder ram
25 right cylinder ram
26 left coupler cylinder
27 right coupler cylinder
28 left connection point (implement cylinder to plate)
29 right connection point (implement cylinder to plate)
30 left connection point (implement cylinder to arm)
31 right connection point (implement cylinder to arm)
32 left pivot pin (top pincer claw to bottom pincer claw)
33 right pivot pin (top pincer claw to bottom pincer claw)
34 left linkage
35 right linkage
36 left sleeve

37 right sleeve
38 left actuator pivot pin (equalizer bar connector to top pincer claw)
39 right actuator pivot pin (equalizer bar connector to top pincer claw)
40 left compression rod
41 right compression rod
42 left connection point (sleeve to arm)
43 right connection point (sleeve to arm)
44 first upper claw
45 second upper claw
46 first lower claw
47 second lower claw
48 outer tips of upper claws
50 left spacer
51 right spacer
52 left equalizer bar connector
53 right equalizer bar connector
54 left arm of equalizer bar
55 right arm of equalizer bar
56 left linkage connector
57 right linkage connector
58 equalizer bar
60 coupler plate
62 left coupler cylinder bracket
63 right coupler cylinder bracket
64 left spring
65 right spring
66 front end loader
68 quick connector
70 link
71 connection point
72 link
74 quick connector plate

DETAILED DESCRIPTION

The present invention may be used with any vehicle having arms for raising and lowering, and also rolling forward and backward, an implement. Although the preferred embodiment of the present invention is intended and adapted for use with a loader or skid steer, those of skill in the art will recognize that the present invention is equally adaptable for use with other utility vehicles including four wheelers and bulldozers. However, for descriptive purposes, the present invention will be described in use on a tractor and/or skid steer.

Figure 2:
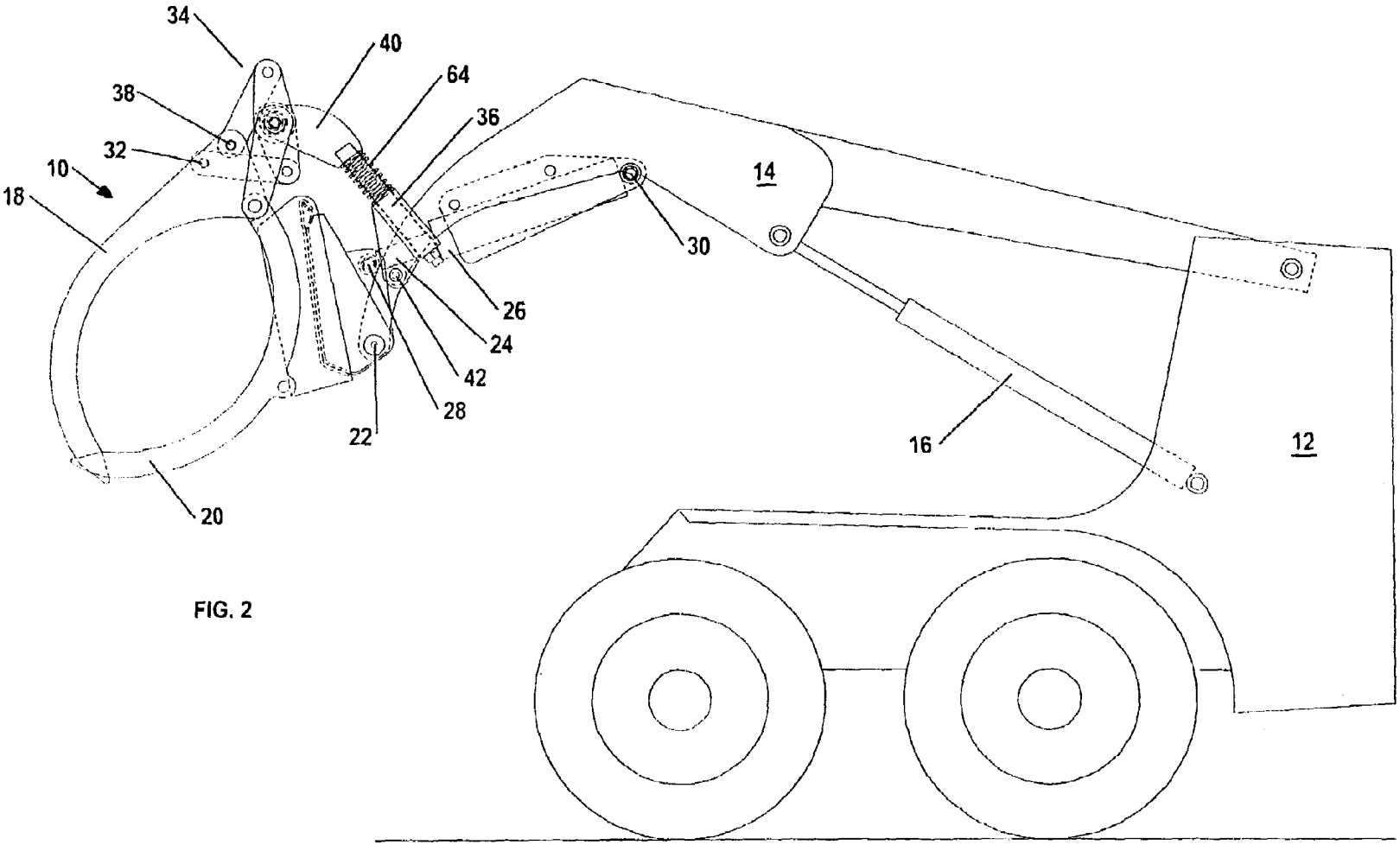
FIG. 2 is a side view of a skid steer with the pinching fingers of the present invention in a slightly opened position.
Figure 3:
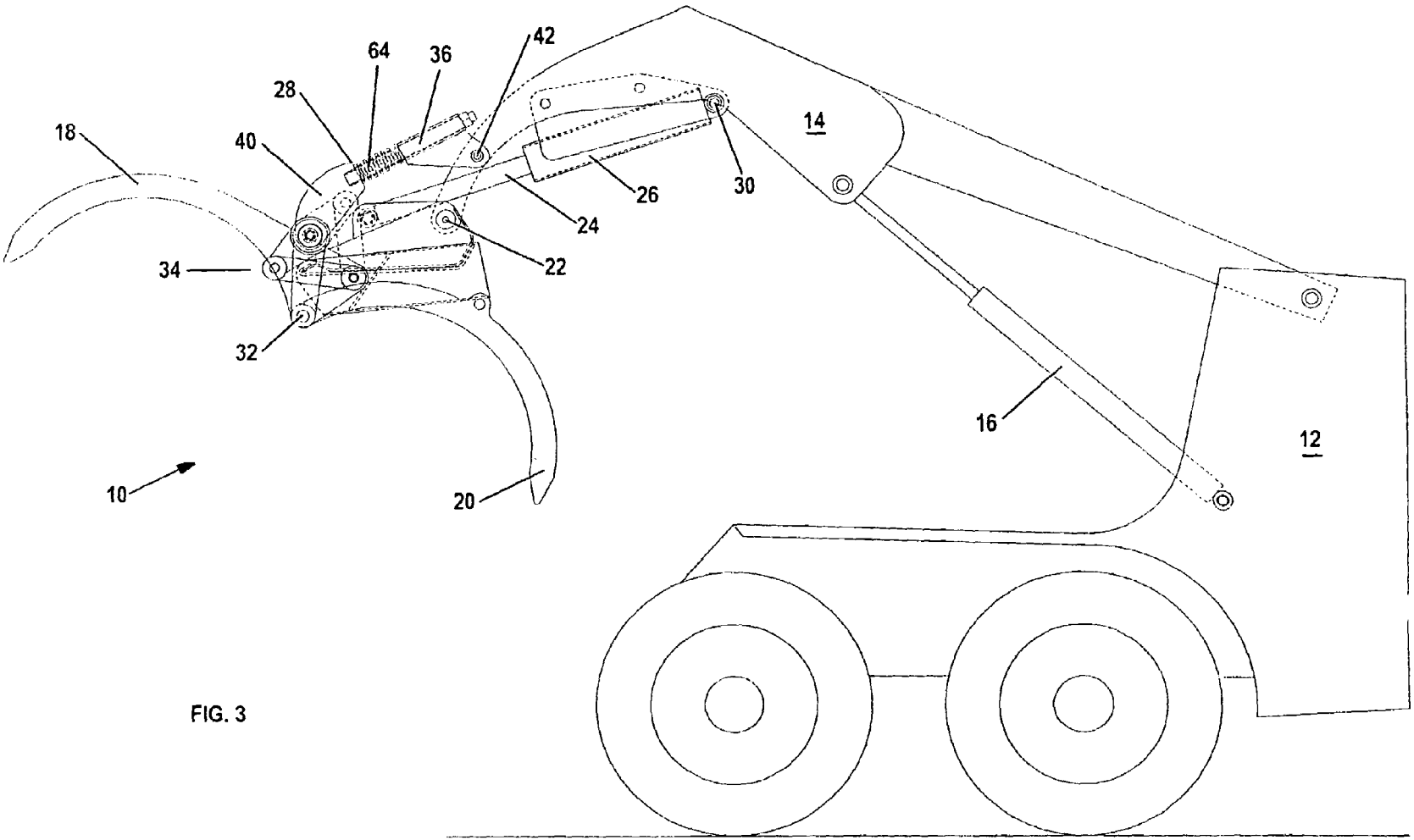
FIG. 3 is a side view of a skid steer with the pinching fingers of the present invention in the fully opened position.

FIGS. 1-3 show the pinching fingers 10 of the present invention attached to a skid steer 12. In this side view, the left side of the skid steer 12 is shown. The skid steer 12 includes a left arm 14 that can be raised and lowered by the left lift cylinder 16. The pinching fingers 10 include a left top pincer claw 18 and a left bottom pincer claw 20. For purposes of describing the operation of the pincer claws 18 and 20 in conjunction with FIGS. 1-3, the left side components will be discussed, although it will be understood that the corresponding right side components are also provided and operate similarly.

The left bottom pincer claw 20 is fixedly attached to a plate (not shown in this view) that is in turn rotatably connected to the left arm 14 at the left coupler pin 22, allowing the left bottom pincer claw 20 to rotate about the left coupler pivot pin 22. The plate is also attached to the end of the cylinder ram 24 of the left coupler cylinder 26 at the connection point 28. The other end of the left coupler cylinder 26 is connected to the left arm 14 at the connection point 30.

The left top pincer claw 18 is rotatably attached to the left bottom pincer 20 claw at the left pivot pin 32, allowing the left top pincer claw 18 to rotate about the pivot pin 32. The left top pincer claw 18 is also attached to the left arm 14 through the left linkage 34 (the components of which are described in detail below) and left compression rod 40. The left linkage 34 is attached to the left top pincer claw 18 at the left actuator pivot pin 38 and also the left pivot pin 32 where the top and bottom pincer claws are connected. The left linkage 34 is attached to the left compression rod 40, which slides through the left sleeve 36. The left sleeve 36 is rotatably connected to the left arm 14 at the left connection point 42. The left compression rod 40 is biased outward from the left sleeve 36 by the left spring 64.

When actuated, the left coupler cylinder 26 rotates the plate and attached left bottom pincer claw 20 about the left coupler pivot pin 22, as shown in FIGS. 1-3. In the fully closed position, shown in FIG. 1, the left linkage 34 closes the left top pincer claw 18 relative to the left bottom pincer claw 20. In the slightly open position, shown in FIG. 2, the left coupler cylinder 26 has rotated the plate and attached left bottom pincer claw 20 forward. The left top pincer claw 18 has also rotated forward, but the left linkage 34 has caused the left top pincer claw 18 to open relative to the left bottom pincer claw 20.

In the fully open position, shown in FIG. 3, the left coupler cylinder 26 has rotated the plate and attached left bottom pincer claw 20 fully forward. The left linkage 34 has caused the left top pincer claw 18 to rotate fully about the pivot pin 32 so that the pincer claws are in a fully open position. Thus, the opening and closing of the pincer claws 18 and 20 is fully controlled by the coupler cylinder 26. The pincer claws 18 and 20 may be raised and lowered by the hydraulic cylinder 16 and arm 14, and opened and closed in any vertical position, allowing items to be picked up off the ground and loaded or unloaded from or into vehicles.

The arm 14 and hydraulic cylinders 16 and 26 are conventional components on any skid steer 12. Corresponding components are found on any tractor (or other vehicle) with a front-end loader, which includes most tractors. Thus, the pinching fingers 10 of the present invention can be raised, lowered, opened and closed with the conventional components found on any skid steer and most tractors, providing significant advantages over prior art grapplers and pinching implements that require the added expense and complexity of additional hydraulic cylinders, lines, couplers and controls.

Figure 4:
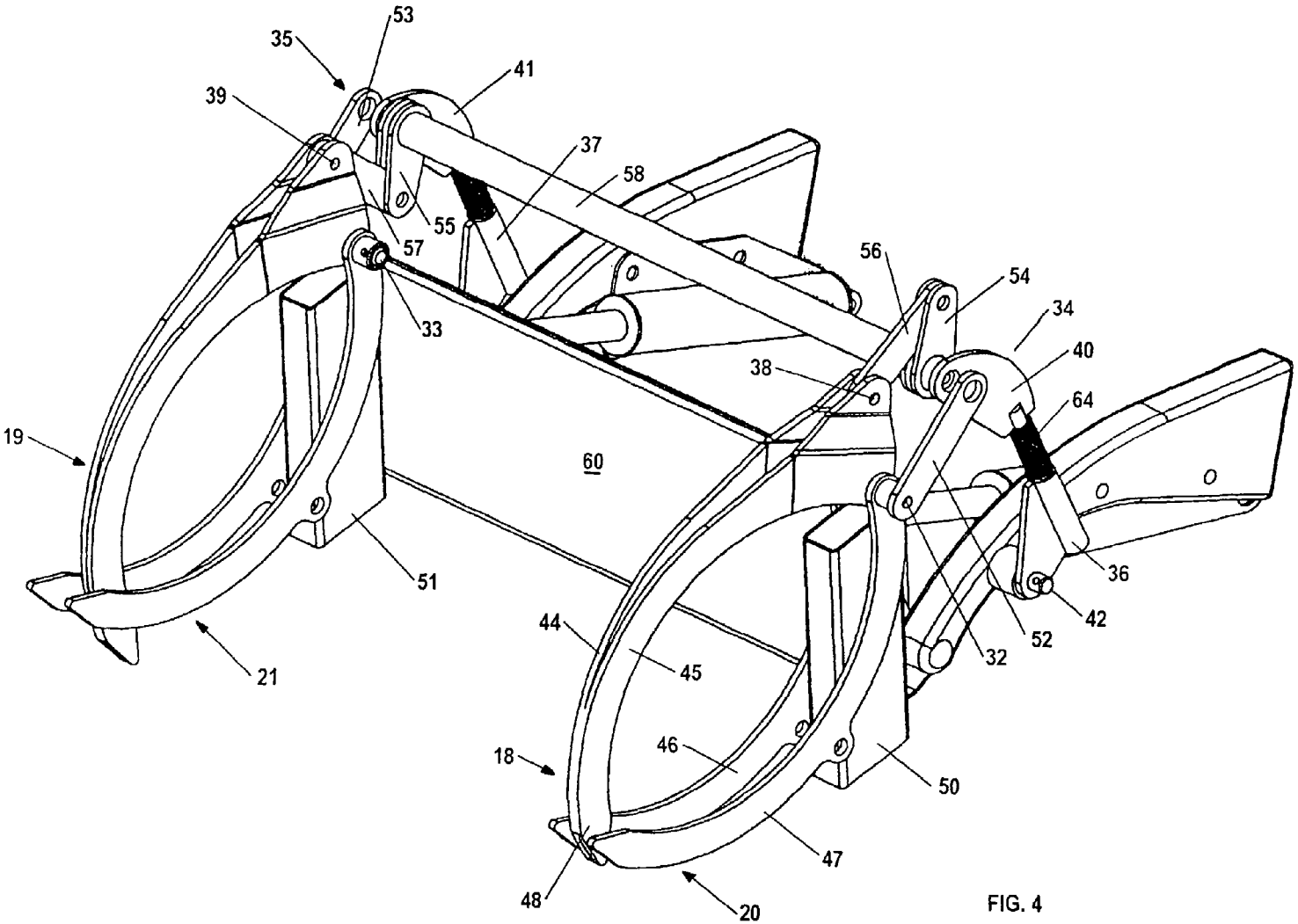
FIG. 4 is a front perspective view of the pinching fingers of the present invention.
Figure 5:
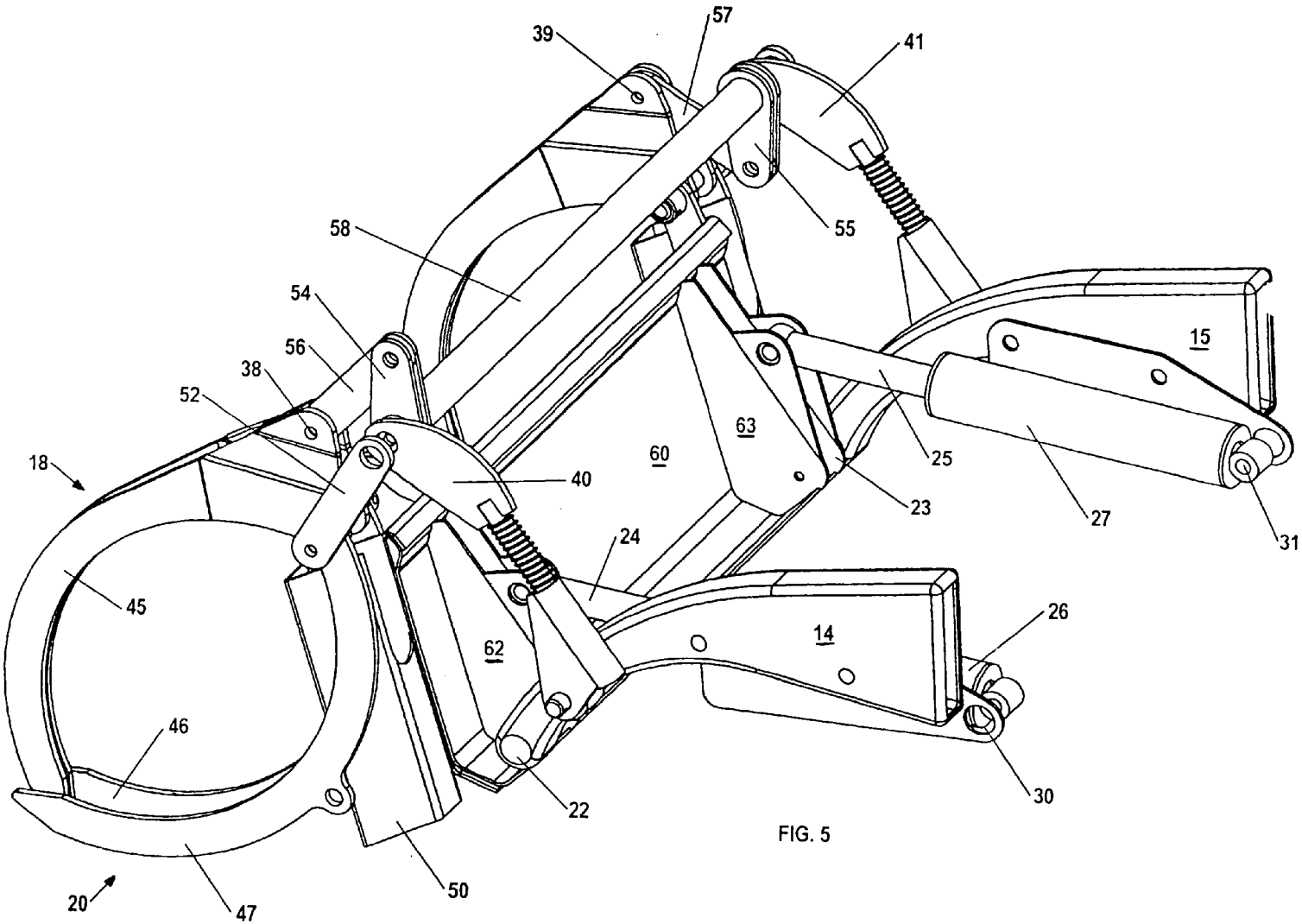
FIG. 5 is a rear perspective view of the pinching fingers of the present invention.
Figure 6:
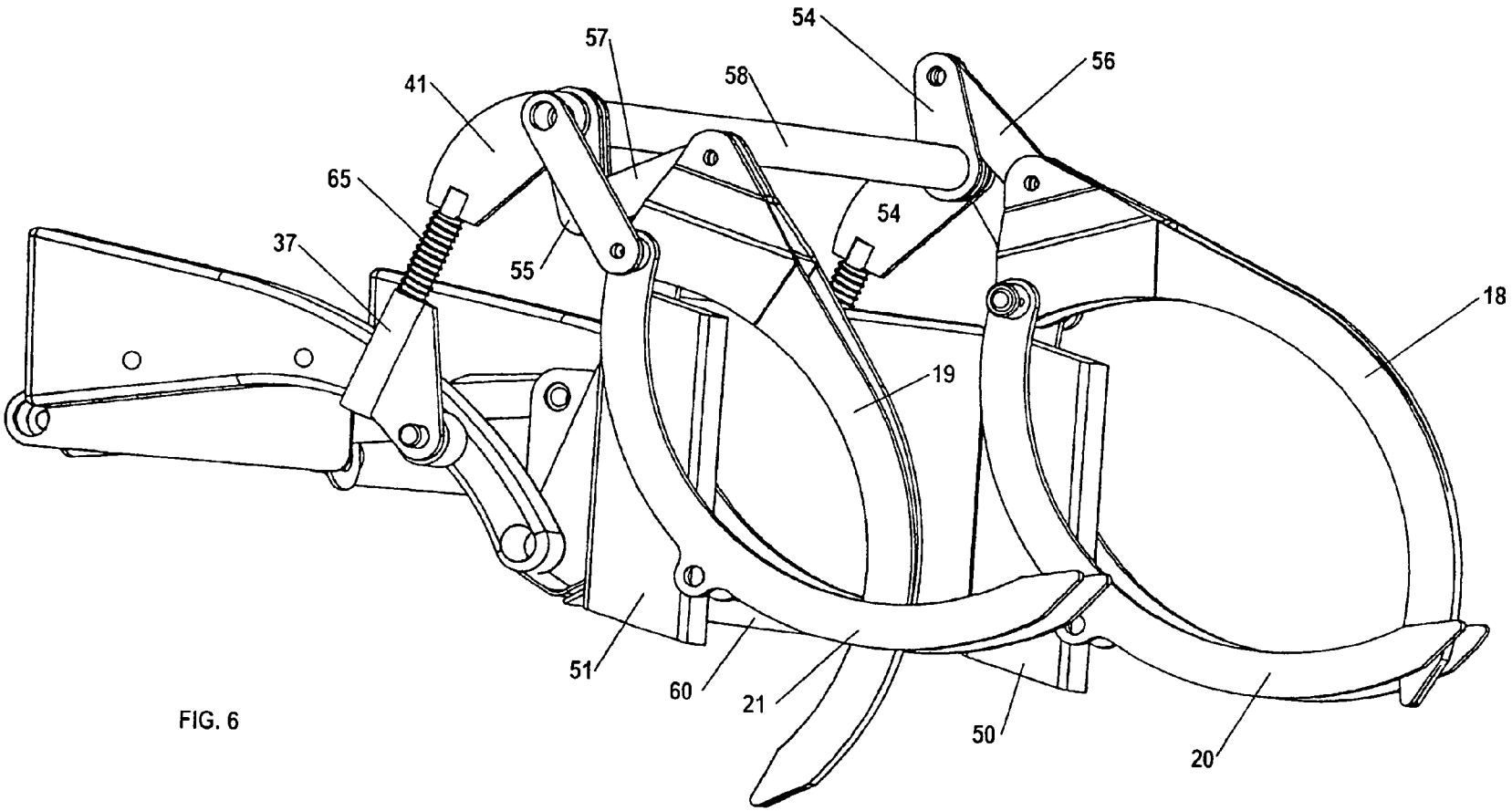
FIG. 6 is a front perspective view of the pinching finger of the present invention with the left fingers (shown on the right side of FIG. 6) in a restricted position and the right fingers (shown on the left side of FIG. 6) in a more closed position.

Details of the construction of the preferred embodiment of the pinching fingers 10 of the present invention are shown in FIGS. 4-6. As shown in FIG. 4, the left top pincer claw 18 (shown on the right side of FIGS. 4 and 6) is comprised of two claws, a first upper claw 44 and a second upper claw 45. The left lower pincer claw 20 is also comprised of two claws, a first lower claw 46 and a second lower claw 47. The right top pincer claw 19 and right bottom pincer claw 21 are similarly constructed. The upper claws 44 and 45 are joined and welded together at their outer tips 48 so that, when the pincer claws are closed, the upper claws 44 and 45 insert between the lower claws 46 and 47. In the closed position, the lower claws 46 and 47 prevent lateral movement of the upper claws 44 and 45, providing increased stability when the pincer claws are closed and grasping an item.

The first lower claw 46 and the second lower claw 47 are attached to a left spacer 50, preferably by welding the arms to the spacer. A corresponding right spacer 51 is also provided. The spacers 50 and 51 provide increased stability for the lower arms and maintain the separation between the lower arms. The spacers 50 and 51 are each attached to the coupler plate 60, preferably by welding the spacers to the plate. The coupler plate 60 provides rigidity and strength between the left and right pincer claws of the grappler 10 and ensures that the bottom pincer claws 20 and 21 operate in unison.

As shown in FIG. 5, which shows the rear side of coupler plate 60, the coupler plate 60 includes a left coupler cylinder bracket 62 and a right coupler cylinder bracket 63 attached to the coupler plate. The brackets 62 and 63 rotatably attach at their lower ends to the arms 14 and 15 of the vehicle at the coupler pivot pins 22 and 23. The brackets 62 and 63 rotatably attach at their midsection to the cylinder rams 24 and 25 of the coupler cylinders 26 and 27 at the connection points 28 and 29. The hydraulic cylinders 26 and 27 rotatably attach to the arms 14 and 15 of the vehicle at the connection points 30 and 31.

The coupler cylinder brackets 62 and 63 may be welded to the coupler plate 60 as an integral component of the pinching fingers 10. The coupler cylinder brackets 62 and 63 may also be adapted for quick connection to the coupler plate 60 to allow for quick removal of the pinching fingers 10 from the tractor or skid steer.

Although the pinching fingers 10 of the present invention are shown attached to a skid steer with dual coupler cylinders 26 and 27, the present invention is equally adaptable for use with a skid steer or other vehicle with a single, central coupler cylinder. To connect to a skid steer with a single coupler cylinder, a single coupler cylinder bracket is used and located on the coupler plate in a position to correspond to the position of the coupler cylinder on the skid steer.

Referring to FIG. 4, the left linkage 34 includes a left equalizer bar connector 52 that is rotatably connected to the left compression rod 40 and rotatably connected to the upper and lower left pincer claws 18 and 20. The left linkage 34 also includes a left linkage connector 56 that is connected to the left top pincer claw 18 at the left actuator pivot pin 38. At its other end, the left linkage connector 56 is connected to a left arm 54 that is welded to the equalizer bar 58. Corresponding components for the right linkage 35, including a right equalizer bar connector 53, a right linkage connector 57 and a right arm 55, are also shown in FIG. 4. Like the left arm 54, the right arm 55 is welded to the equalizer bar 58. The left arm 54 and the right arm 55 of the equalizer bar 58 are oriented in opposite directions. In the position shown in FIG. 4, the left arm 54 is oriented upwards and the right arm is oriented in a 180° opposite downward direction. Because both arms 54 and 55 are welded to the equalizer bar 58, the arms maintain the opposite orientation during movement of the grappler.

The equalizer bar 58 serves to equalize pressure between the left claw and the right claw, providing an additional novel feature to the present invention. In combination with the compression rods 40 and 41, the equalizer bar 58 allows limited independent movement of the left and right pincer claws so that the pinching fingers 10 may reliably grasp and secure items of irregular cross section.

During operation without restriction, the compression rods 40 and 41, equalizer bar 58, arms 54 and 55 and linkage connectors 56 and 57 translate the same movement to the top pincer claws 18 and 19. As the coupler plate 60 is rolled forward by the coupler cylinders 26 and 27, the actuator pivot pins 38 and 39 are pulled backward relative to the pivot pins 32 and 33, opening the claws. As the coupler plate 60 is rolled backwards, the left and right arms 54 and 55 of the equalizer bar 58 work in tandem to exert forward force through the linkage connectors 56 and 57 on the top pincer claws 18 and 19 at the actuator pivot pins 38 and 39. This forward force on the top pincer claws 18 and 19 causes the pinching fingers 10 to close as the coupler plate 60 is rolled backward.

Figure 7:
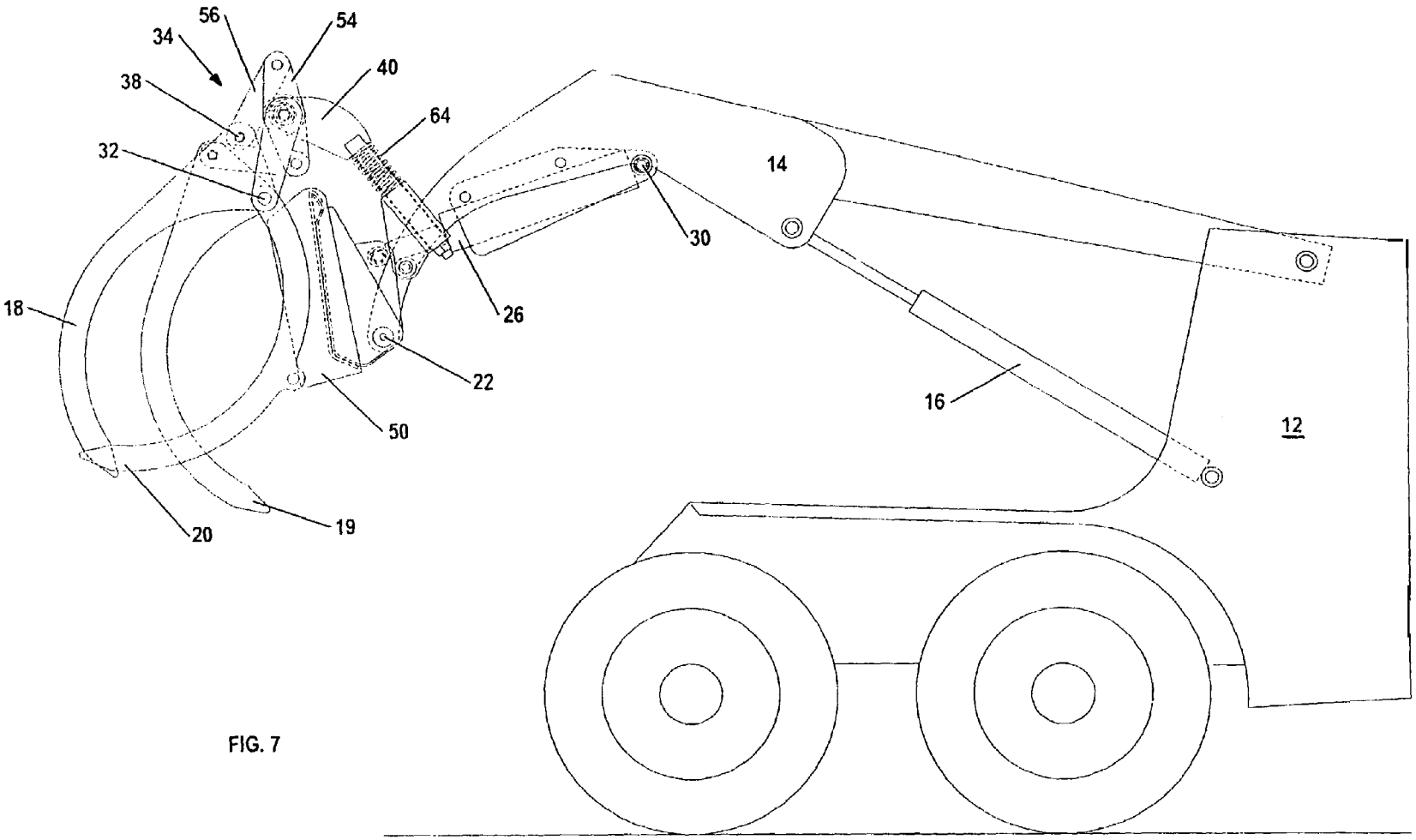
FIG. 7 is a side view of a skid steer with the pinching fingers of the present invention with the left fingers in a restricted position and the right fingers in a more closed position.
Figure 8:
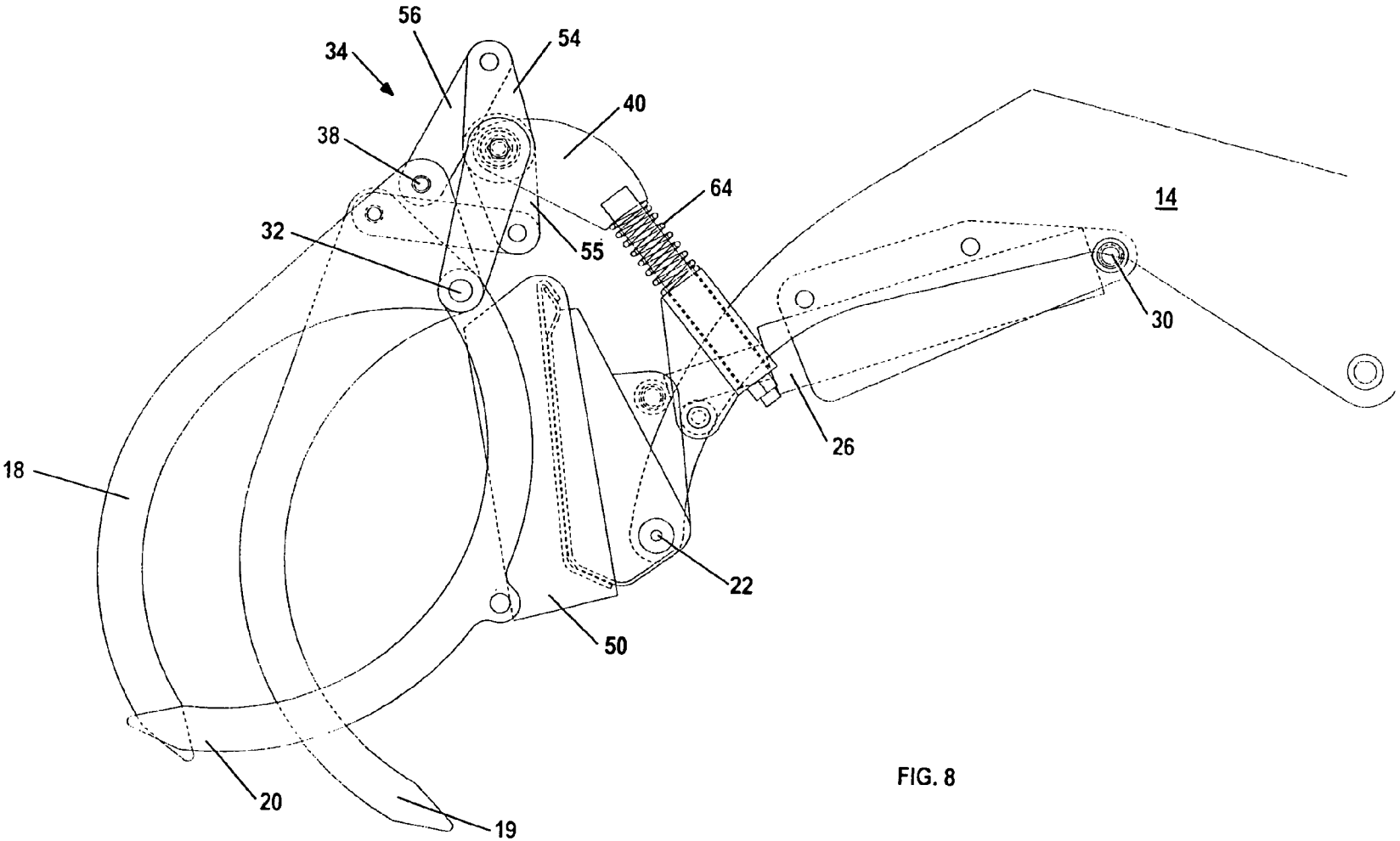
FIG. 8 is a close up side view of the pinching fingers of the present invention with the left fingers in a restricted position and the right fingers in a more closed position.

However, when one claw is restricted from closing, the equalizer bar 58 allows the other claw to continue closing. FIGS. 6 and 7 illustrates the operation of the equalizer bar 58 when one claw is restricted. As shown in FIG. 6, the left top pincer claw 18 has been restricted from closing by an object, not shown, and the coupler plate 60 has been rolled backward past this point of restriction. The right top pincer claw 19 has continued closing because the restriction on the left top pincer clause 18 causes the left arm 54 of the equalizer bar 58 to rotate backward, which in turns rotates the right arm 55 forward. This forward rotation of the right arm 55 closes the right top pincer claw 19 even though the left top pincer claw 18 is restricted. FIG. 8 provides a close up side view of the operation of the linkage 34 when the left top pincer claw 18 is restricted.

Thus, the novel linkage configuration of the present invention provides many advantages over conventional grapplers and pinching implements. The novel linkage configuration allows the pinching fingers to securely grasp items with a tapered or irregular cross section, including trees and logs, making the transport of heavy and cumbersome items much safer. The equalized pressure on the claws also provides more secure and reliable transport of branches and brush, as well as loose, bulk material such as straw and hay. These and other advantages will be readily apparent to those of skill in the art.

Figure 9:
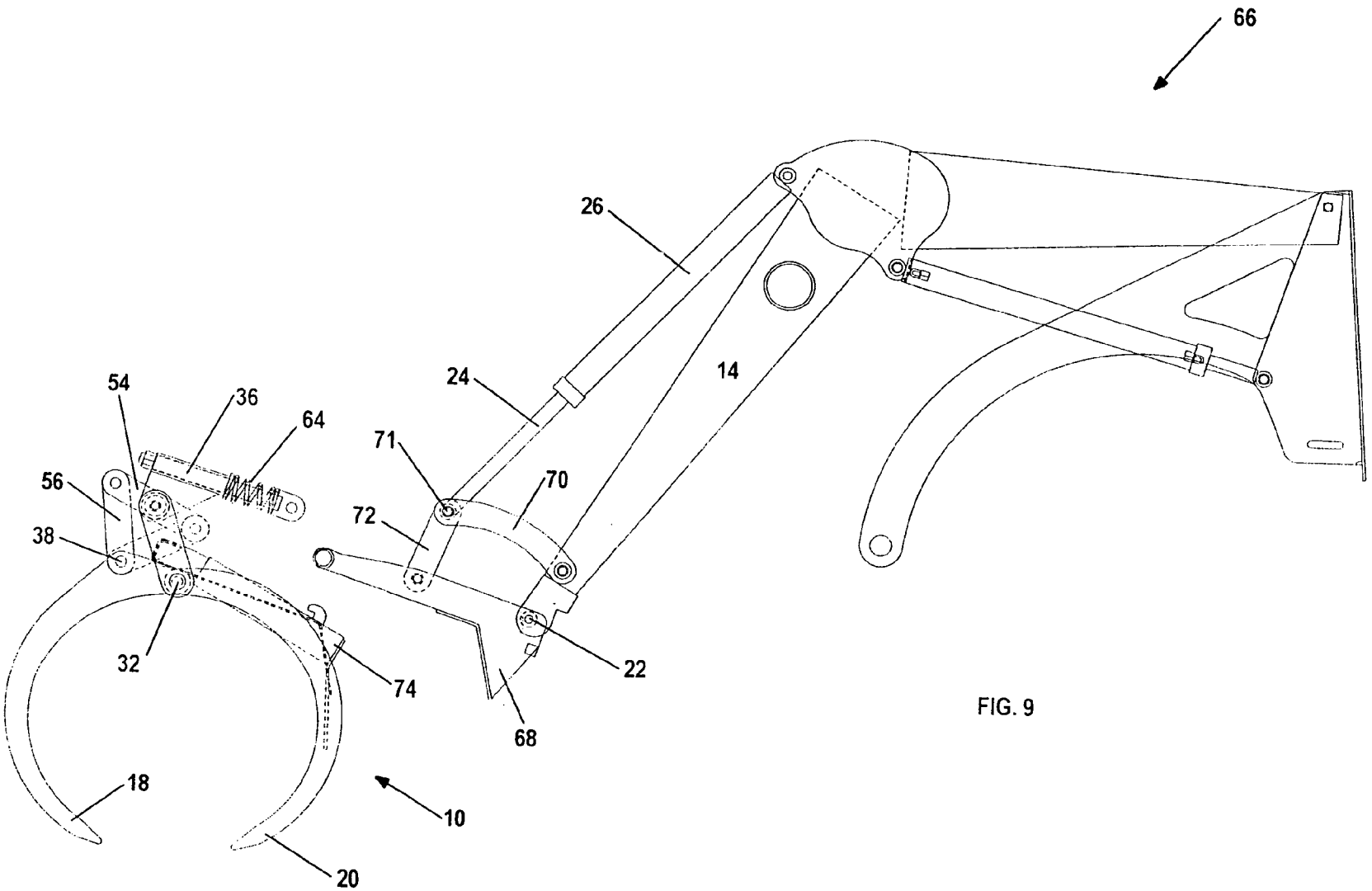
FIG. 9 is a side view of a front end loader with a quick connector and the pinching fingers implement of the present invention prepared for attachment to the quick connector of the front end loader.
Figure 10:
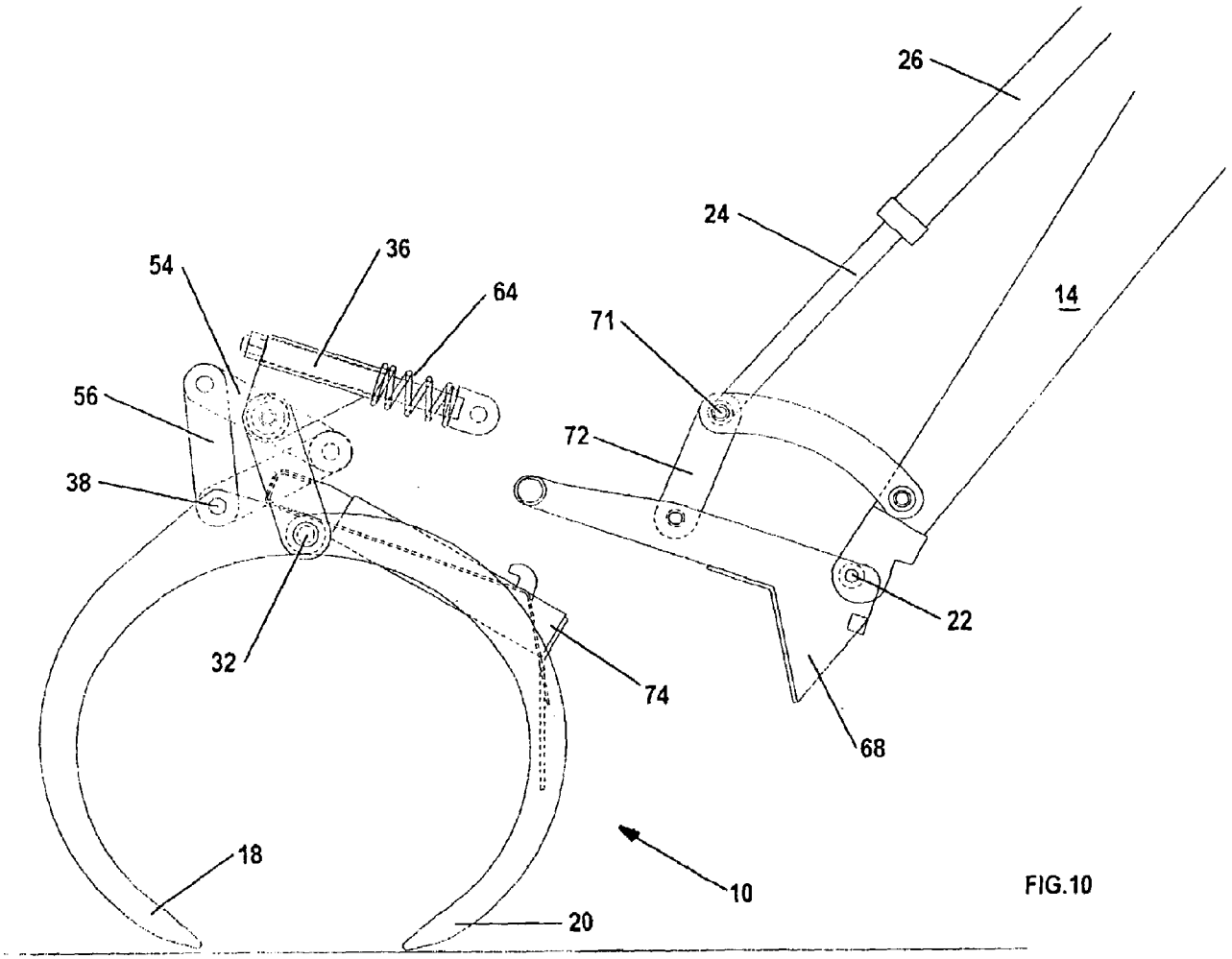
FIG. 10 is a close up side view of the pinching fingers implement of the present invention prepared for attachment to the quick connector of the front end loader.

The pinching fingers 10 of the present invention are also easily adaptable for use with a front end loader 66 commonly found on tractors. As shown in FIGS. 9 and 10, a front end loader 66 may be provided with a quick connector 68. Referring to the left side of the loader, the quick connector 68 is connected to the arm 14 of the front end loader 66 at the coupler pivot pin 22. The quick connector 68 may be rotated about the coupler pivot pin 22 by operation of the coupler cylinder 26. The cylinder ram 24 is attached to the quick connector 68 by the links 70 and 72 at the connection point 71. Corresponding connections and links are provided on the right side of the loader. The pinching fingers 10 are provided with a quick connector plate 74 that mates with and attaches to the quick connector 68. The quick connector 68 allows different sized loaders and specialized implements to be quickly attached, removed and changed from the front end loader.

Figure 11:
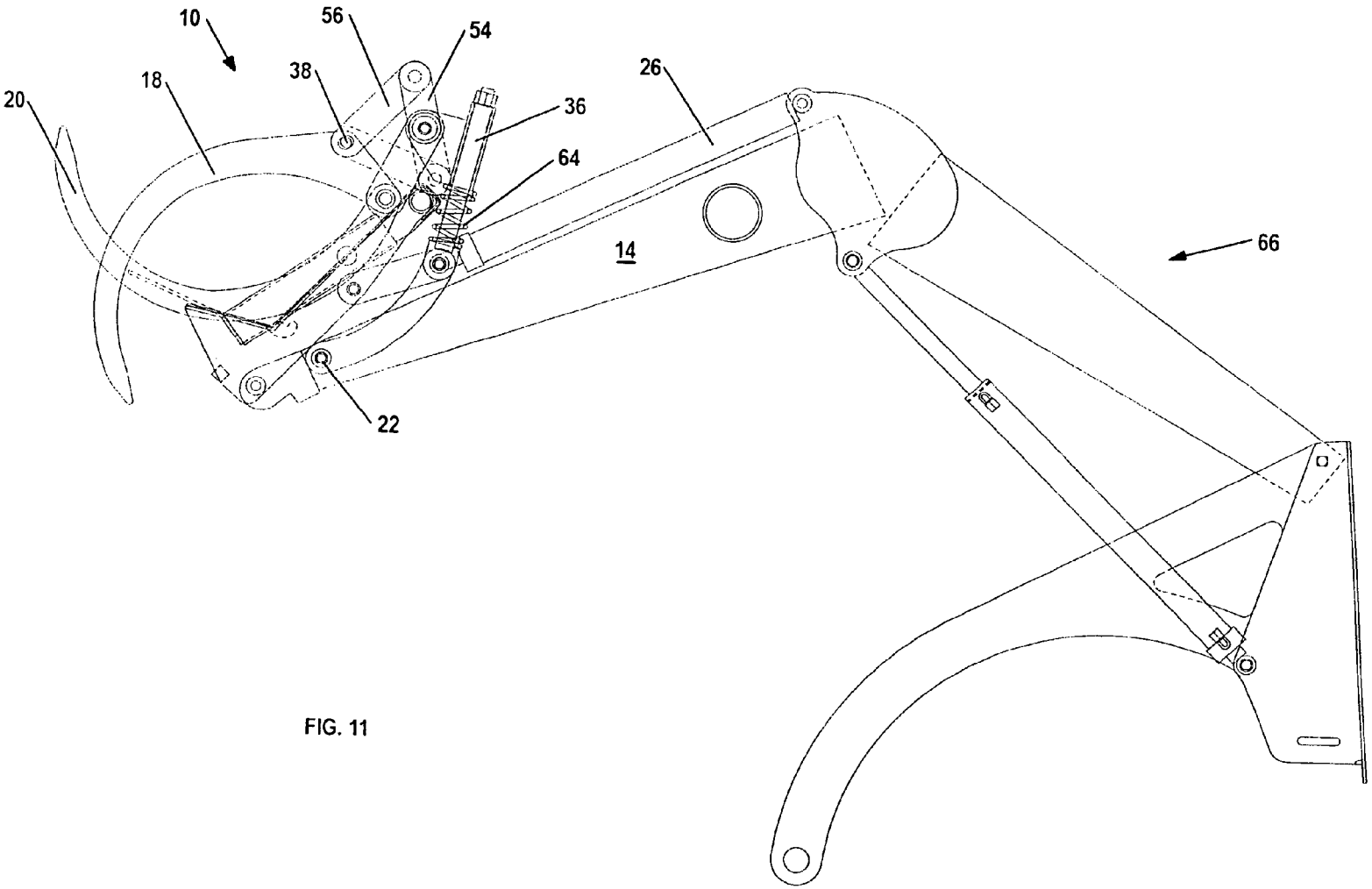
FIG. 11 is a side view of a front end loader with the pinching fingers of the present invention in a closed position.
Figure 12:
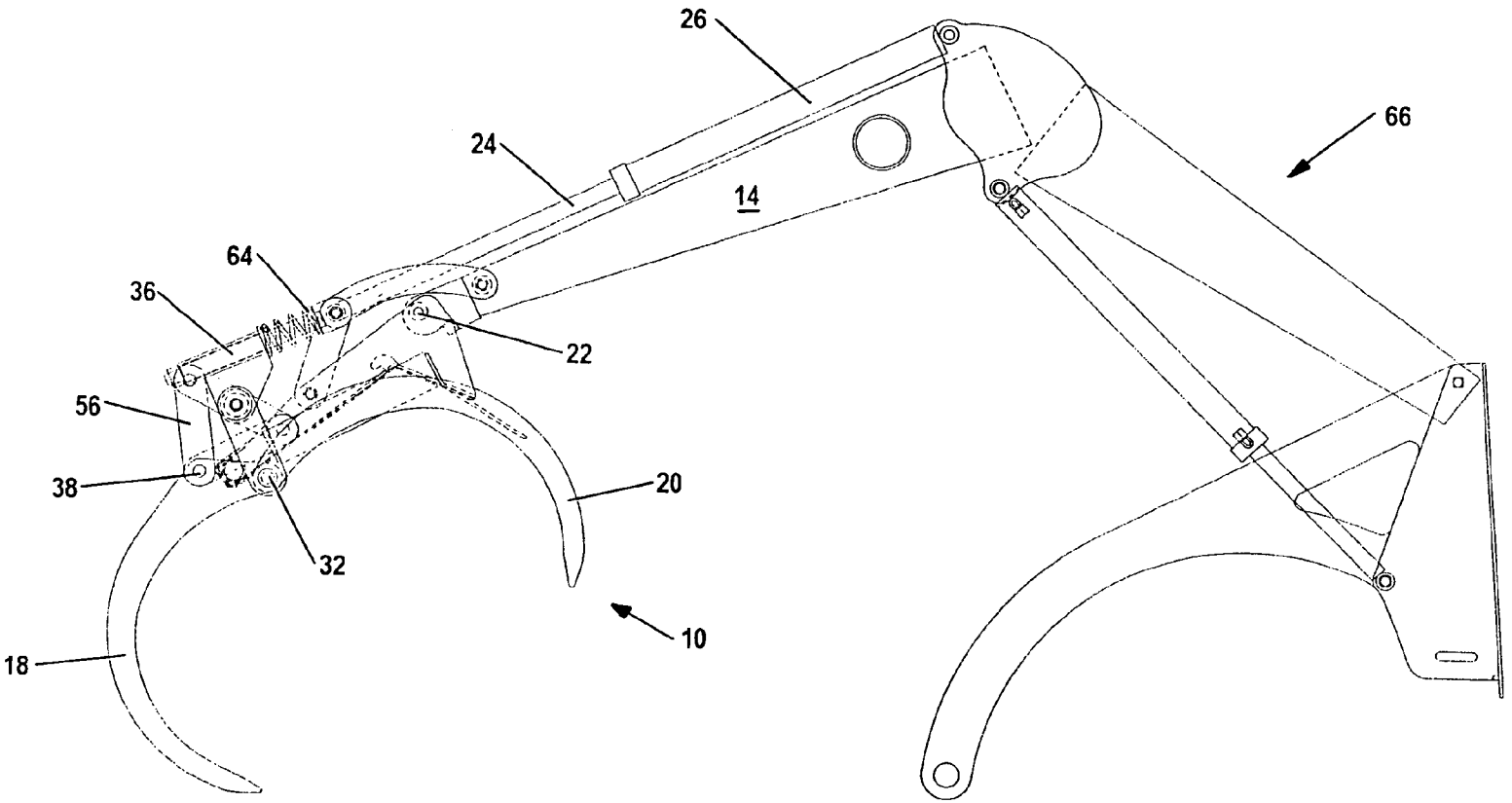
FIG. 12 is a side view of a front end loader with the pinching fingers of the present invention in a opened position.
Figure 13:
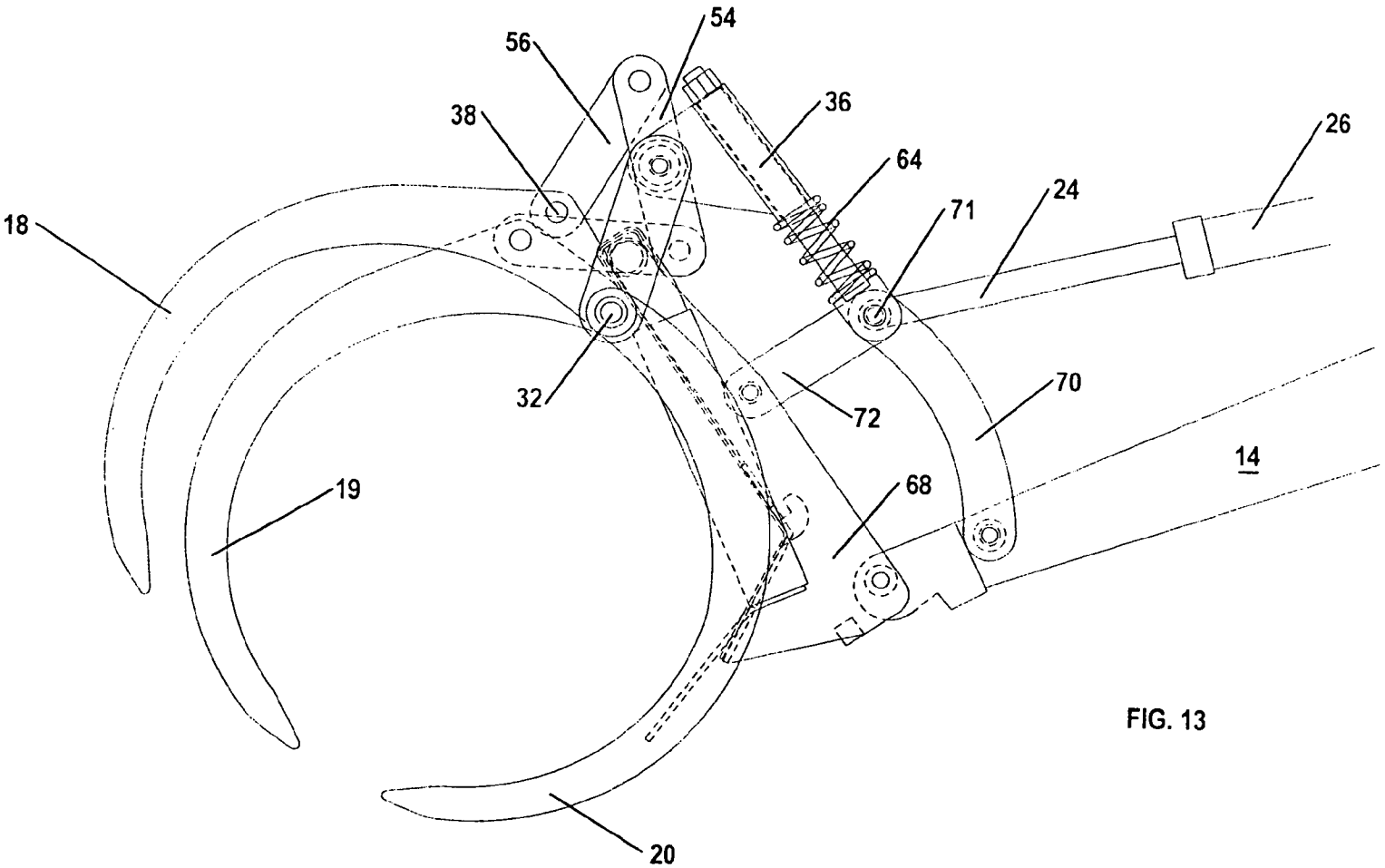
FIG. 13 is a close up side view of the pinching fingers of the present invention on a front end loader with the left fingers in a restricted position and the right fingers in a more closed position.

When connected to the quick connector 66, the pinching fingers 10 may be opened and closed by retraction and extension of the coupler cylinders 26 and 27, as shown in FIGS. 11 and 12. Although adapted for use with a front end loader, the linkage 34 operates as described above to open and close the pinching fingers 10. Also, when one set of fingers is met with a restriction, as shown in FIG. 13, the other set of fingers may continue to close.

Other alterations, variations, and combinations are possible that fall within the scope of the present invention. Although the preferred embodiments of the present invention have been described, those skilled in the art will recognize other modifications that may be made that would nonetheless fall within the scope of the present invention. Therefore, the present invention should not be limited to the apparatus and method described. Instead, the scope of the present invention should be consistent with the invention claimed below.

What is claimed is:

1. An implement comprising:

a first claw;

a second claw rotatably attached to the first claw so that the first claw and the second claw may be opened and closed relative to one another;

a third claw;

a fourth claw rotatably attached to the third claw so that the third claw and the fourth claw may be opened and closed relative to one another;

a pressure equalizing connector having, an equalizer bar, a first arm and a second arm, both arms being rigidly attached to and extending from the equalizer bar;

a first connector having a first end rotatably attached to the first arm and a second end rotatably attached to the first claw;

a second connector having a first end rotatably attached to the second arm and a second end rotatably attached to the third claw.

2. The implement of claim 1 wherein the first arm and the second arm extend in opposite directions from the equalizer bar.

3. The implement of claim 1 further comprising:

a third connector having a first end rigidly attached to the second claw and a second end rigidly attached to the fourth claw.

4. An assembly capable of attachment to a vehicle, the assembly comprising:

a first boom, a second boom, at least one lift cylinder for raising and lowering the booms and at least one implement cylinder for rotating forward and backward an implement when attached to the vehicle; the implement including:

a first claw;

a second claw rotatably attached to the first claw so that the first claw and the second claw may be opened and closed relative to one another;

a third claw;

a fourth claw rotatably attached to the third claw so that the third claw and the fourth claw may be opened and closed relative to one another;

a first linkage for connecting the first claw to the first boom so that the first claw and the second claw may be opened and closed when the implement is rotated;

a second linkage for connecting the third claw to the second boom so that the third claw and the fourth claw may be opened and closed when the implement is rotated; and an equalizing connector connecting to both the first linkage and the second linkage, the equalizing connector providing the first claw with limited independent movement relative to the third claw, and a coupling connecting to and immobilizing the second claw relative to the fourth claw.

5. The assembly of claim 4 with the implement further including the equalizing connector having a first end attached to the first linkage and a second end attached to the second linkage, the equalizing connector functioning to equalize pressure between the first set of linkage and the second set of linkage when the implement is rotated.

6. The assembly of claim 5 with the implement further including:

a first connector having a first end rigidly attached to the second claw an rigidly attached to the fourth claw.

7. The assembly of claim 4 with the implement further including:

a first connector having a first end rigidly attached to the second claw and a second end rigidly attached to the fourth claw wherein the first claw is rotatably connected to the third claw.

8. The assembly of claim 7 with the implement further including the equalizing connector having a first end attached to the first linkage and a second end attached to the second linkage, the equalizing connector operating to equalize the pressure on the first and third claw when the implement is rotated.

9. A vehicle comprising:

a first power means for moving the vehicle forward and backward;

a boom having a first end and a second end, the first end of the boom pivotally connected to the vehicle at a first pivot point so that the boom is capable of rotational movement about the first pivot point, allowing the second end of the boom to be vertically raised and lowered relative to the vehicle;

an implement having a first claw, a second claw rotatably attached to the first claw so that the first claw and the second claw may be opened and closed relative to one another, a third claw and a fourth claw rotatably attached to the third claw so that the third claw and the fourth claw may be opened and closed relative to one another;

a second power means for raising and lowering the implement relative to the vehicle;

a first linkage connecting the first claw to the boom so that the first claw and the second claw may be opened and closed when the implement is rotated;

a second linkage connecting the third claw to the boom so that the third claw and the fourth claw may be opened and closed when the implement is rotated;

an implement cylinder for rotating the implement relative to the vehicle, the rotation of the grappler implement operating to open and close the first claw and the second claw relative to one another and to open and close the third claw and the fourth claw relative to one another;

a pressure equalizing connector having a first end attached to the first linkage and a second end attached to the second linkage, the pressure equalizing connector operating to equalize the pressure on the first claw and the third claw when the implement is rotated.

10. The vehicle of claim 9 further comprising:

a first connector having a first end rigidly attached to the second claw and a second end rigidly attached to the fourth claw, wherein the first claw is rotatably connected to the third claw.

11. A method of operating a pinching implement attached to a first boom and a second boom, the method comprising the steps of:

extending an implement cylinder to open the pinching implement;

withdrawing the implement cylinder to close the pinching implement, the pinching implement comprising:

(a) a first claw;

(b) a second claw rotatably attached to the first claw so that the first claw and the second claw may be opened and closed relative to one another;

(c) a third claw;

(d) a fourth claw rotatably attached to the third claw so that the third claw and the fourth claw may be opened and closed relative to one another;

(e) a pressure equalizing connector having a first end attached to the first linkage and a second end attached to the second linkage, the pressure equalizing connector operating to equalize the pressure on the first claw and the third claw when the implement cylinder is withdrawn.

12. The assembly of claim 4 wherein the second claw further comprises a first pincer and a second pincer.

13. The implement of claim 8 wherein the second claw farther comprises a first pincer and a second pincer.

14. The vehicle of claim 10 wherein the first claw has limited independent movement relative to the third claw.

* * * * *